United States Patent [19]

Melesio

[11] Patent Number: 4,991,851

[45] Date of Patent: Feb. 12, 1991

[54] REFLECTIVE GOLF BALL AND METHOD

[76] Inventor: Ruben Melesio, 324 Sunset Dr., Palatine, Ill. 60067

[21] Appl. No.: 521,299

[22] Filed: May 9, 1990

[51] Int. Cl.[5] ..... A63B 43/06; A63B 69/36

[52] U.S. Cl. ..... 273/213; 273/235 A; 273/DIG. 24; 524/908

[58] Field of Search ..... 273/235 R, 235 A, 235 B, 273/218, 183 C, 213, DIG. 24, 62, DIG. 7; 40/327; 524/908

[56] References Cited

U.S. PATENT DOCUMENTS

| | | | |
|---|---|---|---|
| 1,622,421 | 3/1927 | Coffield | 40/327 |
| 1,795,732 | 3/1931 | Miller | 40/327 |
| 2,568,279 | 9/1951 | Franz et al. | 273/DIG. 24 |
| 2,861,810 | 11/1958 | Veatch | 40/327 |
| 3,709,495 | 1/1973 | Krombein | 273/DIG. 24 |
| 3,918,719 | 11/1975 | Welch | 273/DIG. 24 |
| 3,979,126 | 9/1976 | Dusbiber | 273/218 |
| 4,085,937 | 4/1978 | Schenk | 273/235 A |
| 4,802,674 | 2/1989 | Kitaoh | 273/235 A |
| 4,865,326 | 9/1985 | Isaac et al. | 273/DIG. 24 |

FOREIGN PATENT DOCUMENTS

| | | | |
|---|---|---|---|
| 3117183 | 11/1982 | Fed. Rep. of Germany | 273/DIG. 24 |

*Primary Examiner*—George J. Marlo

*Attorney, Agent, or Firm*—Juettner Pyle Lloyd & Verbeck

[57] ABSTRACT

A regulation golf ball is provided with a solid coating of reflective glass beads. The ball is used for night play with the use of a light source, which is aimed in the direction of flight of the ball, and the light source is used to find the ball.

3 Claims, 3 Drawing Sheets

REFLECTIVE GOLF BALL AND METHOD

BACKGROUND OF THE INVENTION

This invention relates to golf balls and to methods for using the same.

With the increasing popularity of golf as a sport, the number of golfers continues to exceed the availability of facilities. Various proposals have been made, such as the provision of smaller golf courses, together with the use of golf balls which travel shorter distances than conventional balls. Other proposals have included, for example, golf balls containing a light producing element which could be used in the evening or at night. Such a ball is disclosed in U.S. Pat. No. 4,695,055, and it may be seen that the ball must be provided with a cavity or hole to receive the light producing or chemiluminescent element. Obviously, the use of a self-generating source of light in a golf ball imposes many limitations on the construction of the ball and its flight properties.

SUMMARY OF THE INVENTION

In accordance with the present invention, a golf ball, preferably one of conventional construction and having an outer cover, is provided with a thin coating of light reflecting material, such as reflective glass beads in a bonding medium. The reflective ball is used by interposing a beam of light between the golfer and the trajectory or location of the ball. Even with a low power source of light, the flight path and direction of the ball is easily detected. The golfer may then locate the ball by moving toward the new location with a portable light source.

The ball of the present invention is intended to be used as night approaches and is particularly useful at night when other sources of light are absent. Since a conventional golf ball may be used, there is no need for a special ball construction, and golfing at night is made possible in an economical fashion.

THE DRAWING

DESCRIPTION OF THE PREFERRED EMBODIMENT

Figure 1:
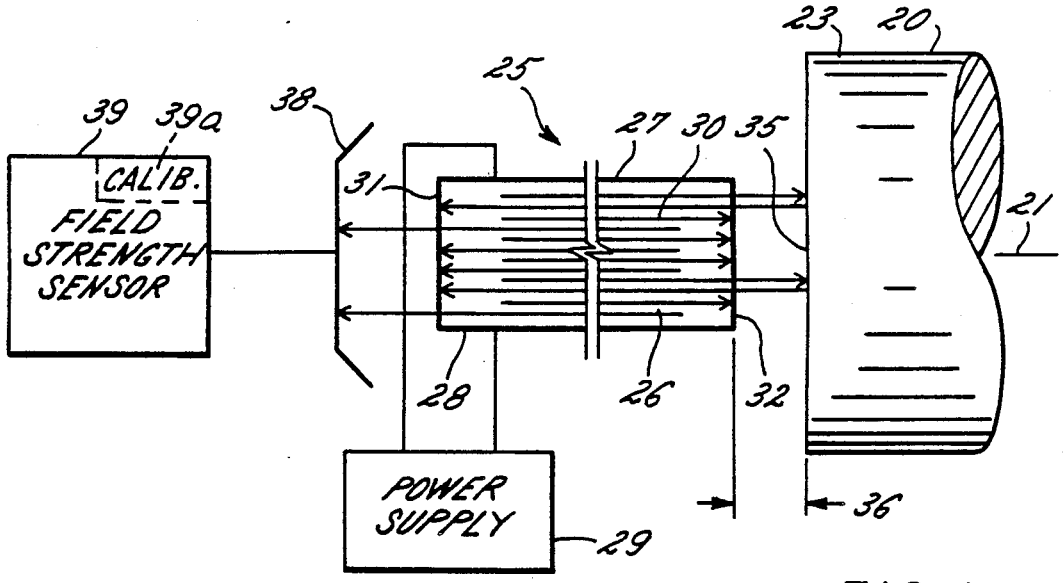
FIG. 1 is a sectional view of a golf ball prepared in accordance with the present invention.
Figure 4:
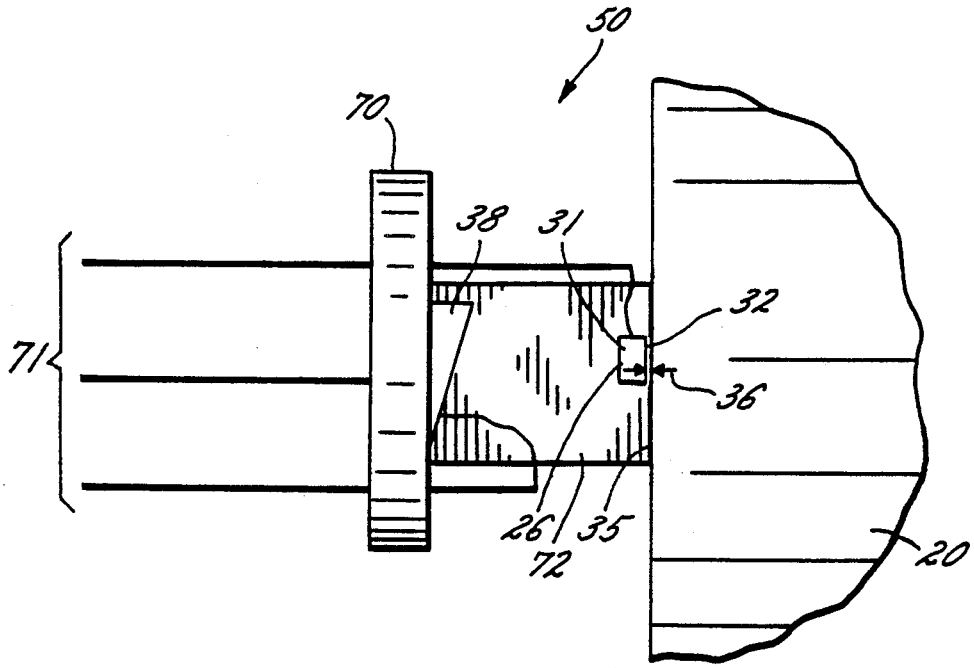

FIG. 1 illustrates a golf ball 10 of conventional construction, including, for example, a solid core 12 surrounded by an outer cover 14 having a dimple pattern. while a two piece ball is shown, other constructions are well known and available, such as three piece and one piece.

The outer surface of the cover 14 of the ball 10 is provided with a light reflecting coating. The coating preferably is comprised of metal coated glass beads having an average size in the order of 35 to 60 microns, disposed in a transparent, curable polymer. A coating of the above mixture is applied by conventional methods such as brushing or spraying and is allowed to dry. Such a coating may be applied in lieu of the conventional pigmented coating used on golf balls.

Reflective paints are available from various sources. One suitable material is available under the trademark "Scotchlite" Reflective Liquid, 7200 series. The glass beads are vapor coating with aluminum, and the index of reflection is in the order of 1.5 to 2.5. The use of vapor coated beads eliminates the necessity of providing a separate reflective layer beneath the beads. Various colors including white and silver, are available.

Upon drying of the reflective liquid, the ball will have a coating consisting essentially of light reflective glass beads on the outer surfaces. No additional transparent coatings should be applied, since the additional coating would adversely affect the reflective properties.

Figure 2:
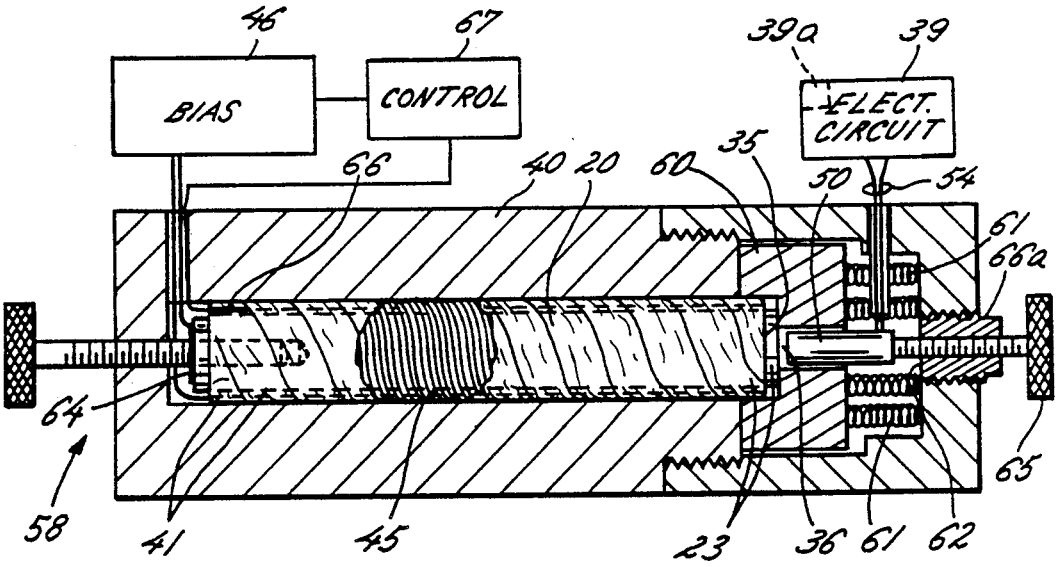
FIG. 2 is a schematic representation illustrating use of the golf ball of the present invention.
Figure 3:
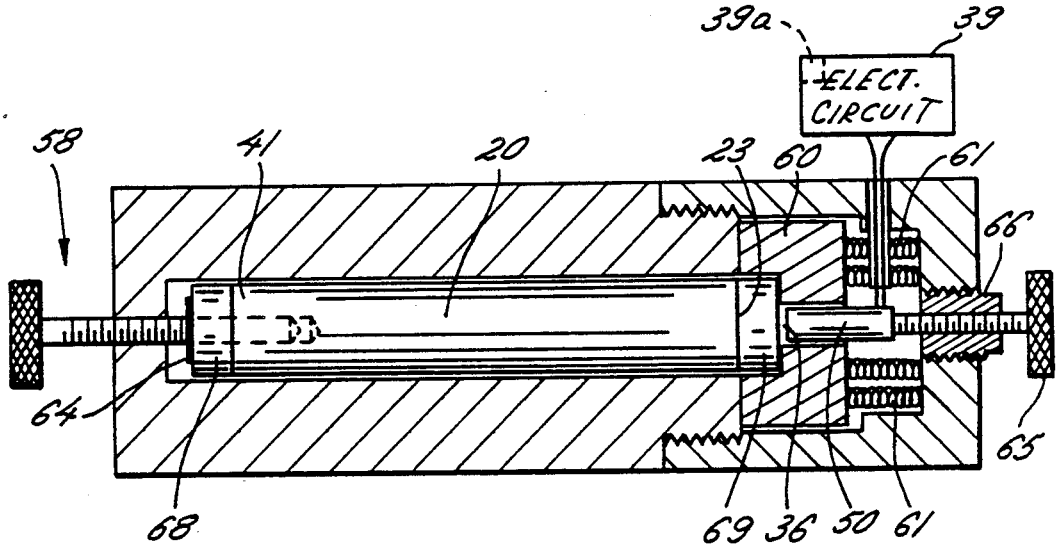
Figure 5:
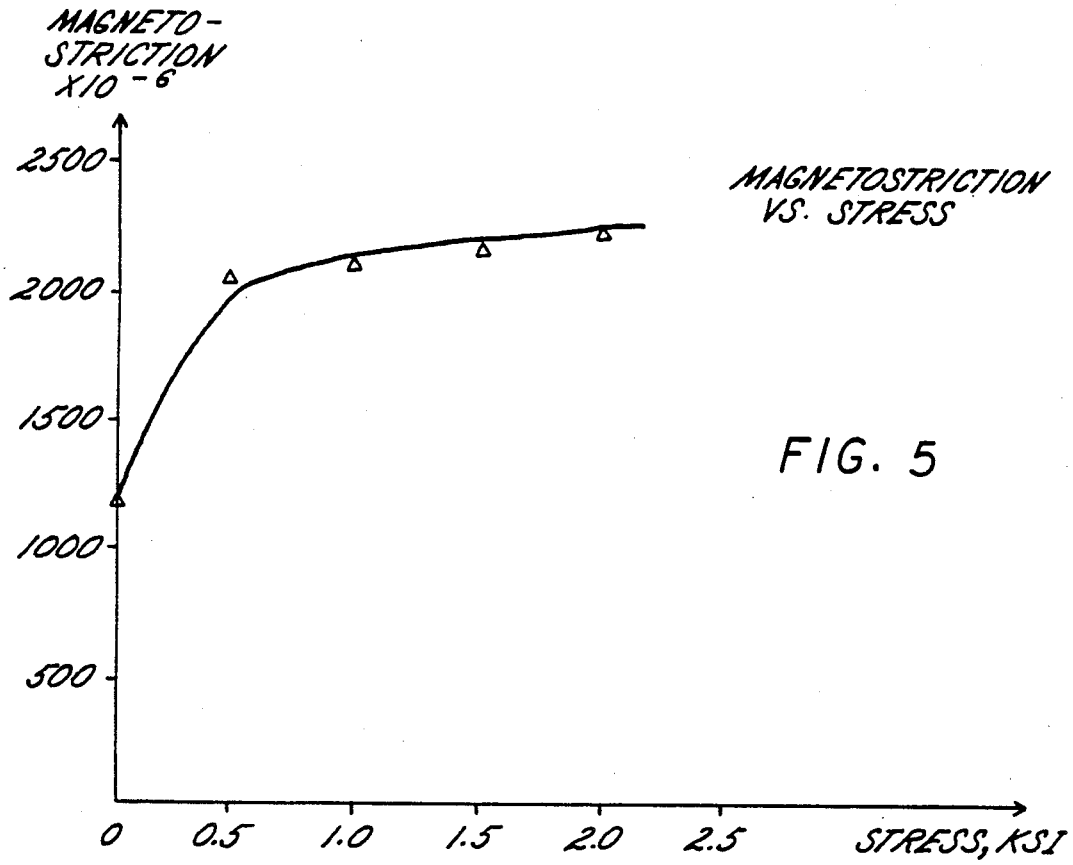
Figure 6:
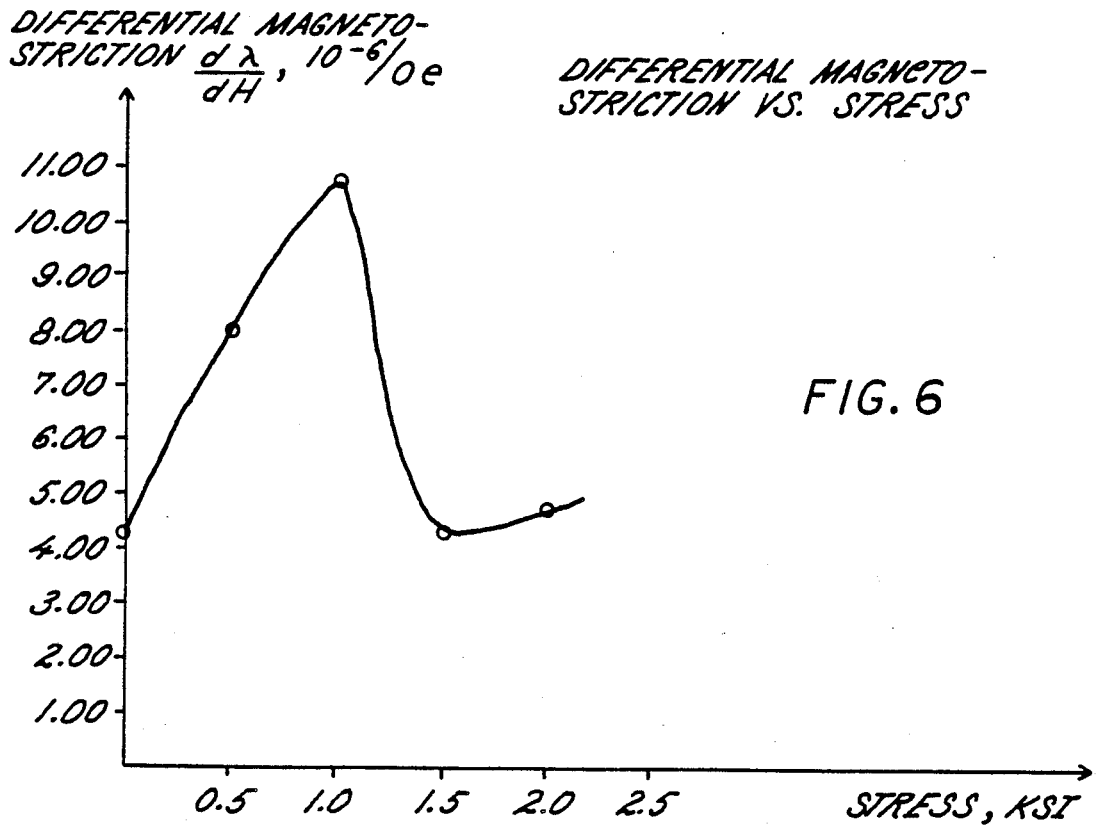

As shown in FIG. 2, the ball 10 is preferably used with two or more permanent or temporary light sources such as 20 and 22. Preferably, the light sources are not located behind the ball but are positioned somewhat ahead of the ball whenever the ball is hit. when looking for the ball, the light sources are positioned between the golfer and the expected location of the ball. These procedures allow for better contrast and allow the reflected light to be seen without interference.

As an example, one or more high power lamps may be mounted on the tee to determine the light path or direction of the ball. As the hole is played, secondary portable lights may be employed, such as fixtures on golf cart or other battery operated lights.

Surprisingly, unless the reflective golf ball is completely hidden from view, the reflective surface is very easy to spot and locate. Although the glass beads tend to degrade upon use, the ball may be converted into one used in conventional play.

I claim:

1. A golf ball for nighttime use, said golf ball comprising a golf ball having an outer surface, and a solid layer of light reflecting material consistency essentially of reflective glass beads disposed on said surface.

2. A method of playing golf at nighttime comprising the steps of providing a golf ball as recited in claim 1 striking the ball from one location to another, and locating the ball by shining a light toward the ball.

3. The method claim 2 wherein the light is located between the eyes of the golfer and the ball location.

* * * * *